US005293747A

United States Patent [19]

Geiger

[11] Patent Number: 5,293,747

[45] Date of Patent: Mar. 15, 1994

[54] POWER REGULATOR FOR A PRESSURE FLUID MOTOR

[75] Inventor: Robert E. Geiger, Sayre, Pa.

[73] Assignee: Ingersoll-Rand Company, Woodcliff Lake, N.J.

[21] Appl. No.: 899,521

[22] Filed: Jul. 27, 1992

[51] Int. Cl.[5] ..... F28B 7/00

[52] U.S. Cl. ..... 60/493; 60/494

[58] Field of Search ..... 60/407, 468, 493, 494; 173/169, 221

[56] References Cited

U.S. PATENT DOCUMENTS

| | | | |
|---|---|---|---|
| 280,247 | 6/1883 | See | 60/494 |
| 2,447,406 | 8/1948 | George | 60/468 |
| 3,298,284 | 1/1967 | Alexander | 91/58 |
| 3,624,820 | 11/1971 | Brown | 415/152 |
| 3,635,605 | 1/1972 | Hall et al. | 417/315 |
| 3,696,834 | 10/1972 | Vonhoff, Jr. | 137/596 |
| 3,833,068 | 9/1974 | Hall | 173/169 |
| 3,924,961 | 12/1975 | Hess et al. | 415/32 |
| 3,951,217 | 4/1976 | Wallace et al. | 173/169 |
| 3,989,113 | 11/1976 | Spring, Sr., et al. | 173/163 |
| 4,016,940 | 4/1977 | Spring, Sr. | 173/169 |
| 4,404,799 | 9/1983 | Dudek | 60/407 |
| 4,821,515 | 4/1989 | Stein | 60/494 |

FOREIGN PATENT DOCUMENTS

| | | | |
|---|---|---|---|
| 363543 | 10/1938 | Italy | 60/468 |

*Primary Examiner*—Edward K. Look
*Assistant Examiner*—F. Daniel Lopez
*Attorney, Agent, or Firm*—Walter C. Vliet

[57] ABSTRACT

A method and device for regulation of the output power of a fluid power motor involving the bypass of a selected portion of the supplied pressure fluid to the motor exhaust as a means of effectively reducing the available pressure drop across the motor and thereby its power output.

10 Claims, 4 Drawing Sheets

POWER REGULATOR FOR A PRESSURE FLUID MOTOR

BACKGROUND OF THE INVENTION

This invention relates generally to reversing valves for power tools and more particularly to a method and apparatus for the control of pressure fluid supplied to a pneumatically operated hand held power tool for power output regulation.

In the past, power regulation for pressure fluid driven power tools have been accomplished by restricting the flow of pressure fluid supplied to the power tool or restricting the exhaust to back pressure the tool for reduced power. The restricting devices in general reduce power output of the tool even in the minimum restriction settings because the supply pressure fluid must still pass through the device on "full" power settings.

The foregoing illustrates limitations known to exist in present reversing valves for power tools. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a power regulating means for a pressure fluid motor comprising an inlet means for supplying pressure fluid to the motor; an exhaust means for exhausting expanded pressure fluid from the motor; and adjustable means for bypassing a selected portion of the supplied pressure fluid to the exhaust means as a means for selectively reducing the output power of the pressure fluid motor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
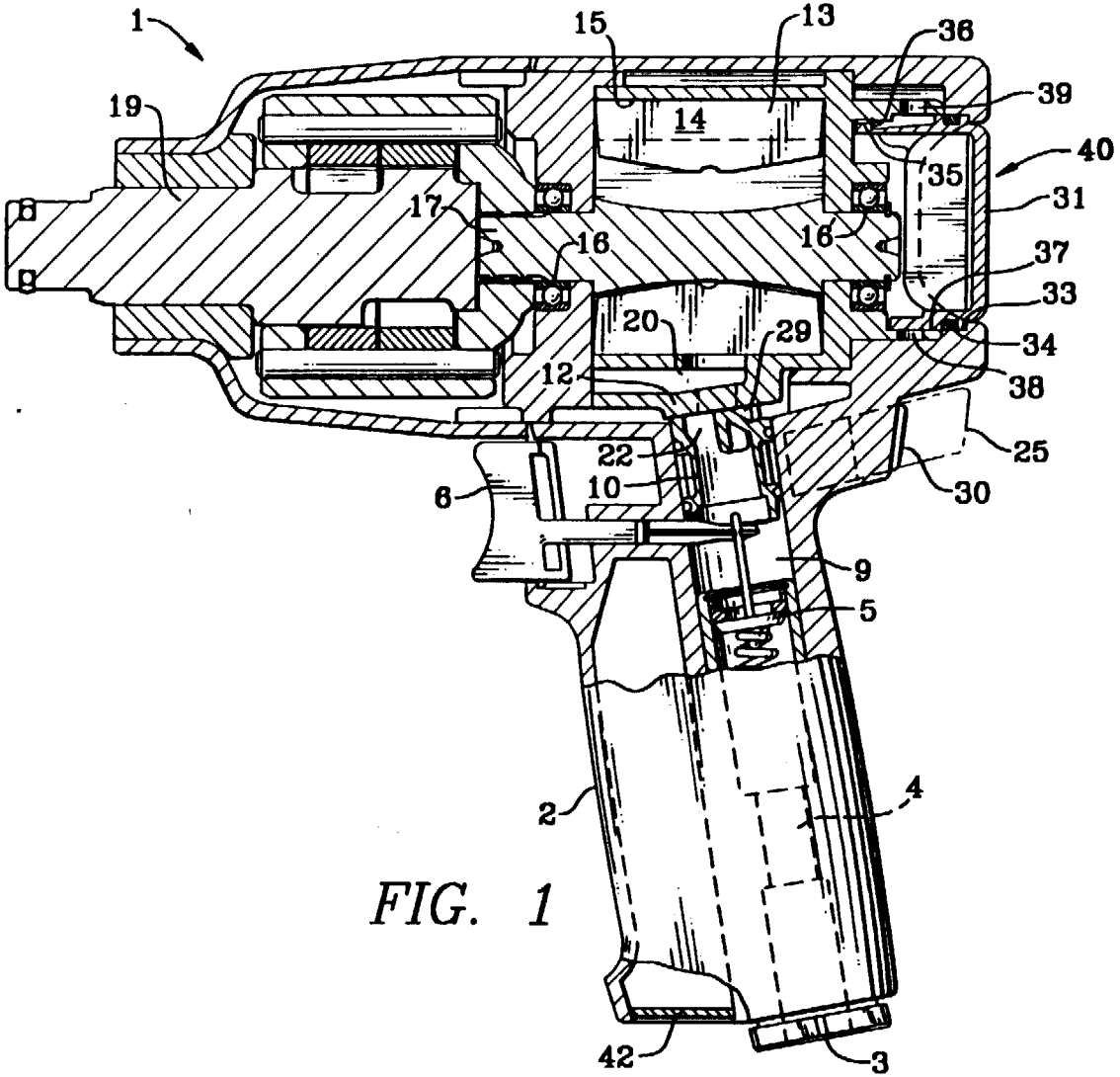
FIG. 1 is a sectional side elevation view of a power regulated power tool according to the present invention.

Referring to FIG. 1, a partial power tool is shown in partial section. The power tool 1 is provided with a handle 2 having a pneumatic fluid or air inlet 3 for providing motive fluid to a pneumatic operated motor or air motor 13. Air is supplied to the air motor through air inlet passageway 4. A tilt valve 5 is operated by means of a trigger 6 to admit pressure fluid to a chamber 9.

Disposed within chamber 9 is a rotary spool element performing as a reversing valve means for selectively distributing pressure fluid to a forward supply port 20 or optionally a reverse port 21 (shown hidden behind the forward port 20 at a position approximately opposite the forward port in the planer plate 12).

The reversing valve spool 10 is provided with a planer segmented end which slidingly cooperates with the planer surface of the plate 12. The spool 10 contains forward and reverse passages 22 and 23 (hidden), and a notched area 29 which handles secondary exhaust, as will be described later in greater detail.

Air entering the forward or reverse ports 20 or 21 selectively proceeds to drive the air motor 13 in forward or reverse direction as the air is expanded against motor vanes 14 in the motor cylinder 15. The motor rotates on bearings 16 and 16' to drive an output shaft 17 which in turn drives a rotating shaft 18 of the working output device 19.

Figure 8:
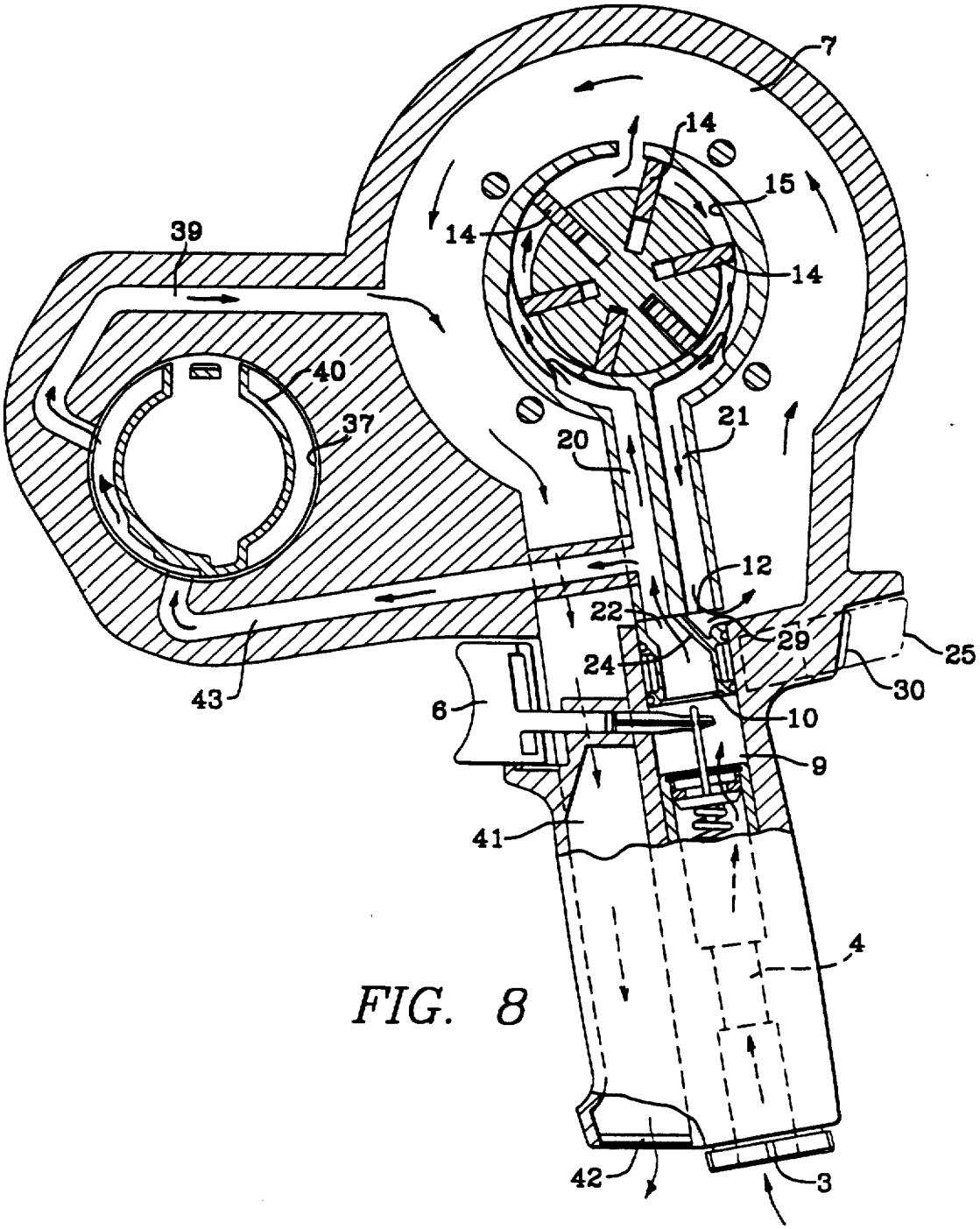
FIG. 8 is a partial component/partial schematic depiction of the power regulating circuit of the present invention in the forward or tightening mode.
Figure 9:
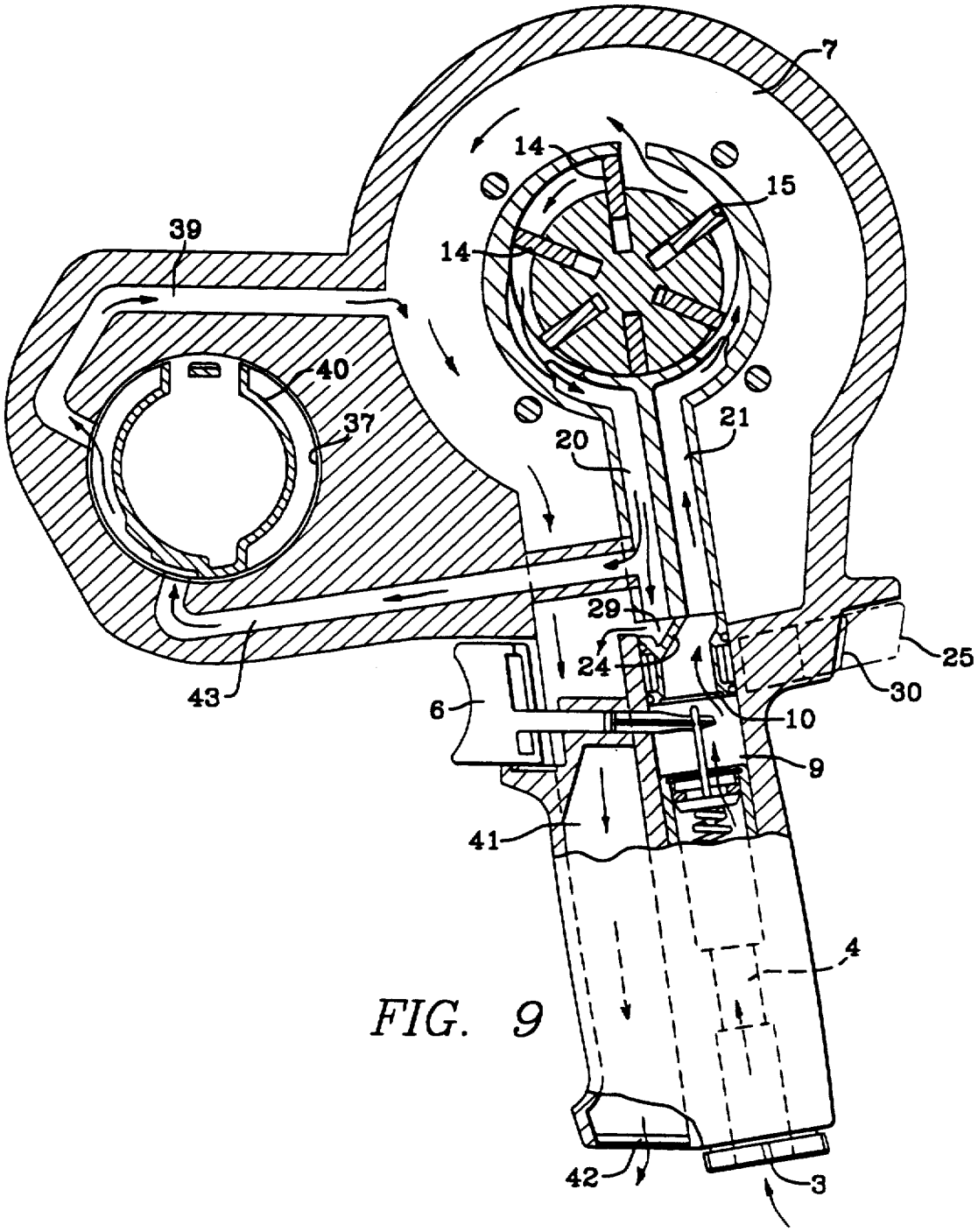
FIG. 9 is a partial component/partial schematic depiction of the power regulator cycle of the present invention in the reverse or untightened mode.

Referring now to FIG. 8 and FIG. 9 for operation, air passing the spool 10 from air passage 4 in chamber 9 is directed to one of two face termination passageways 22 or 23 depending on the selected orientation of partition 24. The ports 22, 23 selectively register with either forward port 20 or the reverse port 21 in the valve plate 12. The notched area 29 registers with corresponding ports 20 or 21 to bleed secondary exhaust which prevents recompression. The notched area 29 allows the secondary exhaust to enter main exhaust cavity 7.

Since passageways 22 and 23 are located approximately 90 degrees apart and the forward and reversing ports 20, 21 are located approximately 180 degrees apart, it can be appreciated by one skilled in the art that rotating the reversing valve spool 10 approximately 90 degrees by depressing either the forward pushbutton 30 or the reverse pushbutton 25 will bring one or the other of passageways 22 or 23 in contact with one of the ports 20 or 21 leading to either the forward or reverse chambers of the motor.

It may now be appreciated by one skilled in the art that rotating the reversing valve spool 10 will accomplish direction of motive fluid to either forward or reverse the motor.

The present invention is directed particularly towards the regulation of pressure fluid supplied to the air motor. As previously described, prior art attempts have throttled the pressure fluid being supplied to the pressure fluid motor or restricted the exhaust to back pressure the motor thereby reducing power output. According to the present invention a method of pressure fluid regulation is disclosed which does not involve restricting the supplied pressure fluid or restricting the exhaust, thereby permitting, in at least one selected operating position, full power application without the need for passing the pressure fluid through a restricting device. This is accomplished in the preferred embodiment by bypassing a selected portion of the supplied pressure fluid directly to the exhaust thereby effectively back pressuring the exhaust while bleeding off a portion of the available pressure fluid.

The dual action of the present invention effectively reduces power output and the apparatus for accomplishing it may be best understood by referring now to FIG. 1 wherein a bypass regulator 40 is shown installed at the back end of the power tool in line with the motor. The regulator best seen in FIGS. 3–6 may be described as an irregular cylinder closed at one end having a knob 31 formed in the closed end to facilitate rotation of the regulator.

Towards one end of the periphery of the cylinder is formed a bearing ring 32 which cooperates with a shoulder 33 formed in the end of the tool housing to retain the bypass regulator and permit its rotation about its cylindrical axis in tool bore 37. A groove 33 is also formed in the periphery near the closed end of the cylinder which receives an "O" ring 34. The "O" ring 34 prevents the escape of pressure fluid from the housing.

Figure 6:
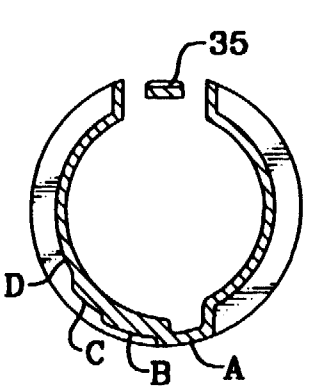
FIG. 6 is a cross section view of the power regulator according to the present invention taken at Section A—A of FIG. 5.
Figure 5:
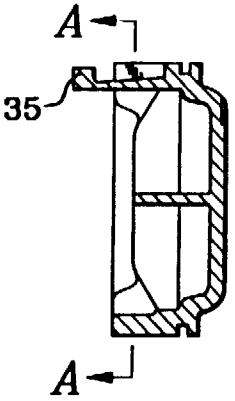
FIG. 5 is a cross section view of the power regulator taken at Section B—B of FIG. 4.

As best seen on FIG. 6, the periphery of the regulator 40 towards the open end is provided with a series of power regulating steps designated A,B,C, and D in descending order from the periphery of the cylinder.

As will be later described in more detail, these steps cooperate with a pressure fluid supply port to permit a greater degree of pressure fluid bypass from essentially zero (when step A cooperates with the port) to a maximum (when the pressure fluid port is positioned adjacent to step D).

Figure 7:
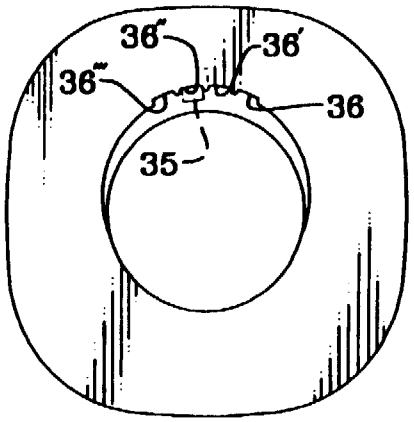
FIG. 7 is an end elevation view of the power regulator showing the rotary step indexing of the power regulator index finger in cooperation with indexing indentations in the housing.
Figure 4:
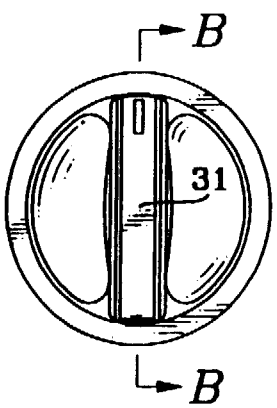
FIG. 4 is a back elevation view of the power regulator according to the present invention.
Figure 3:
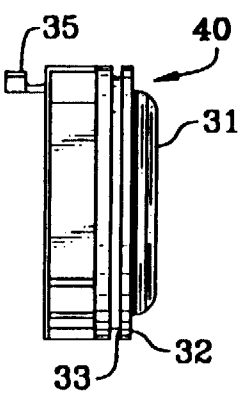
FIG. 3 is a side elevation view of the power regulator according to the present invention.

The regulator cylinder is also provided with an axially extending indexing finger 35 which cooperates with a series of indexing indentations 36, 36', 36'', and 36''', formed in the rear of the tool housing as best seen in form in FIG. 7.

Each of the four indexed positions 36, 36', 36'', 36''' shown corresponds to a position placement of the steps A–D with the reaction to the pressure fluid supply port previously mentioned. Maximum power output being achieved when step A is in register with the port to minimum power when step D is adjacent the pressure fluid port.

Figure 2:
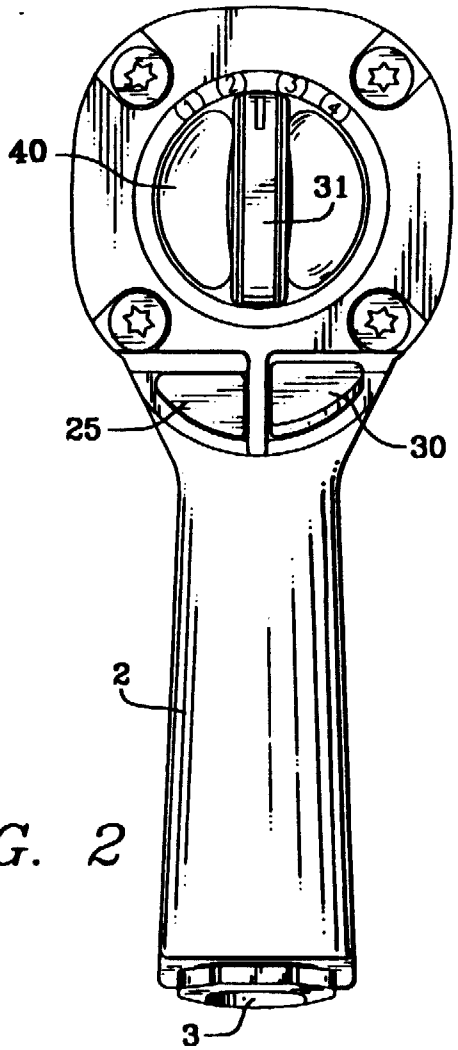
FIG. 2 is a back end elevation view showing the power regulators' convenient location on the back end of the tool.

The bypass regulator 40 is installed in a cylindrical bore 37 and is free to rotate therein. The rotary position of the bypass regulator may be selected by turning knob 31 to the desired position as indicated by the degree of power output dots best seen on FIG. 2. The selected position is retained by the index finger 3 cooperating with the index positioning grooves 36, 36', 36'', 36''' as previously described.

An inlet pressure fluid port 38 is disposed in the periphery of the bore to cooperate with the periphery of the regulator. An exhaust bore 39 on the periphery of the bore 37 and spaced apart from the pressure fluid inlet port 38 permits the bypass pressure fluid to enter the exhaust of the power tool motor.

Operation of the tool is best understood as previously introduced by referring to FIGS. 8 and 9 which depict the major components in form while schematically interconnecting them for ease of understanding.

It should be understood by one skilled in the art that the porting provided in the casing of the power tool utilizes formed interspaced channels within the housing and are difficult to depict in planer presentation. For this reason the schematic presentation of the fluid channels were chosen so that the flow patterns within the power tool might be readily understood.

FIG. 8 shows the forward operation of the power tool during a typical tightening mode in, for example, an impact wrench. As previously described, the inlet pressure fluid which may be air, is selectively supplied to a chamber 9 wherein it further enters a reversing valve 10. The rotary position of the reversing valve spool is selected by means of depressing the appropriate pushbutton.

When the trigger 6 is depressed, air enters the pressure fluid supply passageway 20 leading to the forward motor port from whence the pressure fluid or air enters the vane motor 13. In the motor it is expanded against the vanes 14 to rotate the motor in the forward direction. Expanded air exhausts the motor via exhaust passageway or port 7 which eventually exits through the handle exhaust passageway 41 and exhaust screen or muffler 42 to atmosphere.

According to the present invention, a portion of the pressure fluid supplied to the motor is directed to the regulator 40 by means of passage 43 and escapes through the regulator past the regulator step (B in the depicted case) and exits the regulator through exit port 39 to exhaust cavity 7 to be merged with the primary exhaust, thereby accomplishing both a bleeding of the air pressure supplied to the motor and back pressuring the exhaust as a means of regulating the motor power.

Secondary recompression and exhaust of the pressure fluid in the motor exits port 21 and is passed through the notch 29 into exhaust cavity 7 to eventually be exhausted to atmosphere as previously described.

Reverse operation of the tool is depicted in FIG. 9 wherein depression of the reverse pushbutton 30 rotates the reverse valve to the position shown. Valve partition 24 closes off the forward supply port and redirects the air or pressure fluid to the reverse port 21 of the motor. The pressure fluid is expanded against the motor vanes 14 to rotate the motor in the reverse direction again exhausting through the exhaust cavity 7 as previously described.

Secondary reverse recompression and exhaust is passed in reverse direction through forward port 20 and is passed through notch 29 into exhaust cavity 7 and eventually to atmosphere, as previously described, and is also free to flow through the power regulator 40 through passageway 43, exit port 39 and finally exhaust cavity 7 to atmosphere as previously described.

What is claimed is:

1. A power regulator for a pneumatic pressure fluid motor comprising:

a pneumatic pressure fluid motor means;

an inlet means for supplying pneumatic pressure fluid to said motor means;

an exhaust means for exhausting expanded pressure fluid from said motor means to atmosphere; and adjustable means for bypassing a selected portion of said supplied pressure fluid to said exhaust means as a means for selectively backpressurizing said pneumatic pressure fluid motor as a means for reducing the output power of said pneumatic pressure fluid motor.

2. A power regulator for a pressure fluid motor according to claim 1, wherein said pneumatic pressure fluid motor further comprises a rotary vane air motor.

3. A power regulator for a pneumatic fluid motor according to claim 1, wherein said pressure fluid motor further comprises a rotary vane air motor in a power tool.

4. A power regulator for a pneumatic pressure fluid motor according to claim 1, wherein said inlet means for supplying pressure fluid to said motor means further comprises a passageway including a valve means for controlling the flow of pressure fluid to said motor means.

5. A power regulator for a pressure pneumatic fluid motor according to claim 1, wherein said exhaust means further comprises a passageway extending from said motor means to a muffler and thereafter to atmosphere.

6. A power regulator for a pneumatic pressure fluid motor according to claim 1, wherein said inlet means for supplying pressure fluid to said motor means further comprises an inlet passageway including a valve means for controlling the flow of pressure fluid to said motor means, and said exhaust means further comprises an exit passageway extending from said motor means to a muffler and thereafter to atmosphere, and said adjustable means for bypassing a selected portion of said supplied pressure fluid to said exhaust means as a means for selectively reducing the output power of said pressure fluid motor further comprises a passageway interconnecting said inlet passageway and said exit passageway.

7. A power regulator for a pneumatic pressure fluid motor according to claim 6, wherein said means for selectively reducing the output power of said pressure fluid motor further comprises a bypass passageway including a flow regulating means for controlling the amount of pressure fluid bypassed in said bypass passageway.

8. A power regulator for a pneumatic pressure fluid motor according to claim 6, wherein said means for controlling the amount of pressure fluid bypassed in said bypass passageway further comprises a rotatable cylinder disposed in a bore, interspaced in said bypass passageway.

9. A power regulator for a pneumatic pressure fluid motor according to claim 8, wherein said rotatable cylinder is provided with progressive step relief means o its periphery which cooperate with a bypass passageway port means for regulating the amount of pressure fluid passing along the periphery of said rotatable cylinder to a second bypass passageway port means addressing said bore.

10. A power regulator for a pneumatic pressure fluid motor comprising:

a pneumatic pressure fluid motor means;

an inlet means for supplying pneumatic pressure fluid to said motor means;

an exhaust means for exhausting expanded pressure fluid from said motor means to atmosphere;

adjustable means for bypassing a selected portion of said supplied pressure fluid to said exhaust means as a means for selectively backpressurizing said pneumatic pressure fluid motor as a means for reducing the output power of said pneumatic pressure fluid motor; and said adjustable means for bypassing a selected portion of said supplied pressure fluid to said exhaust means as a means for selectively reducing the output power of said pressure fluid motor bypasses secondary exhaust from said pressure fluid motor in a reverse mode of operation.

* * * * *